US005695024A

United States Patent [19]

Wan et al.

[11] Patent Number: 5,695,024

[45] Date of Patent: Dec. 9, 1997

[54] CAR OPERATED SAFETY GATE FOR HORIZONTALLY TRANSFERRABLE ELEVATOR CAB

[75] Inventors: Samuel C. Wan, Simsbury; Frederick H. Barker, Bristol; Bruce A. Powell, Canton; Gilbert W. Wierschke, West Simsbury; Paul Bennett, Waterbury; Anthony Cooney, Unionville; Richard C. McCarthy, Simsbury; Joseph Bittar, Avon, all of Conn.

[73] Assignee: Otis Elevator Company, Farmington, Conn.

[21] Appl. No.: 564,702

[22] Filed: Nov. 29, 1995

[51] Int. Cl.[6] ..... B66B 13/10

[52] U.S. Cl. ..... 187/326; 187/333

[58] Field of Search ..... 187/318, 326, 187/325, 333; 49/116

[56] References Cited

U.S. PATENT DOCUMENTS

| | | | |
|---|---|---|---|
| 398,615 | 2/1889 | Heine et al. | 187/326 |
| 3,434,609 | 3/1969 | Bosworth et al. | 214/95 |
| 5,090,515 | 2/1992 | Takahashi et al. | 187/16 |

*Primary Examiner*—Kenneth Noland

[57] ABSTRACT

A safety gate (24) is slidable vertically from an upper position at an elevator cab landing (22) where it obstructs movement of the elevator cab (20) into a hoistway, and a lower position that permits cab travel between a car frame (29) and the landing. An actuator (42) normally urges the gate upwardly; the actuator is moved by a cam assembly (36) on an approaching elevator car frame so as to slide the gate (24) downward, out of the way of cab motion.

6 Claims, 5 Drawing Sheets

CAR OPERATED SAFETY GATE FOR HORIZONTALLY TRANSFERRABLE ELEVATOR CAB

TECHNICAL FIELD

This invention relates to a safety gate that prevents a horizontally moveable elevator cab from entering an empty hoistway, the gate being moved out of the way by an approaching elevator car frame to permit transfer of a cab between the landing and the car frame.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and power consumption are prohibitively large.

Since the loading and unloading of passengers takes considerable time, in contrast with high speed express runs of elevators, another way to increase hoistway utilization, thereby decreasing core requirements, includes moving the elevator cab out of the hoistway for unloading and loading, as is described in a commonly owned, copending U.S. patent application Ser. No. (Attorney Docket No. OT-2297), filed contemporaneously herewith.

DISCLOSURE OF INVENTION

Objects of the invention include provision of a mechanical safety device to ensure that horizontally moveable elevator cabs do not enter a hoistway except when there is an elevator car frame adjacent to the landing.

According to the present invention, a vertically slidable gate member extends above a landing to prevent a horizontally moveable elevator cab from entering an adjacent hoistway, and the gate is lowered by an actuator operated by an approaching elevator car frame. According further to the invention, the safety gate may be lowered in response to an upward-traveling car frame or in response to a downward traveling car frame.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
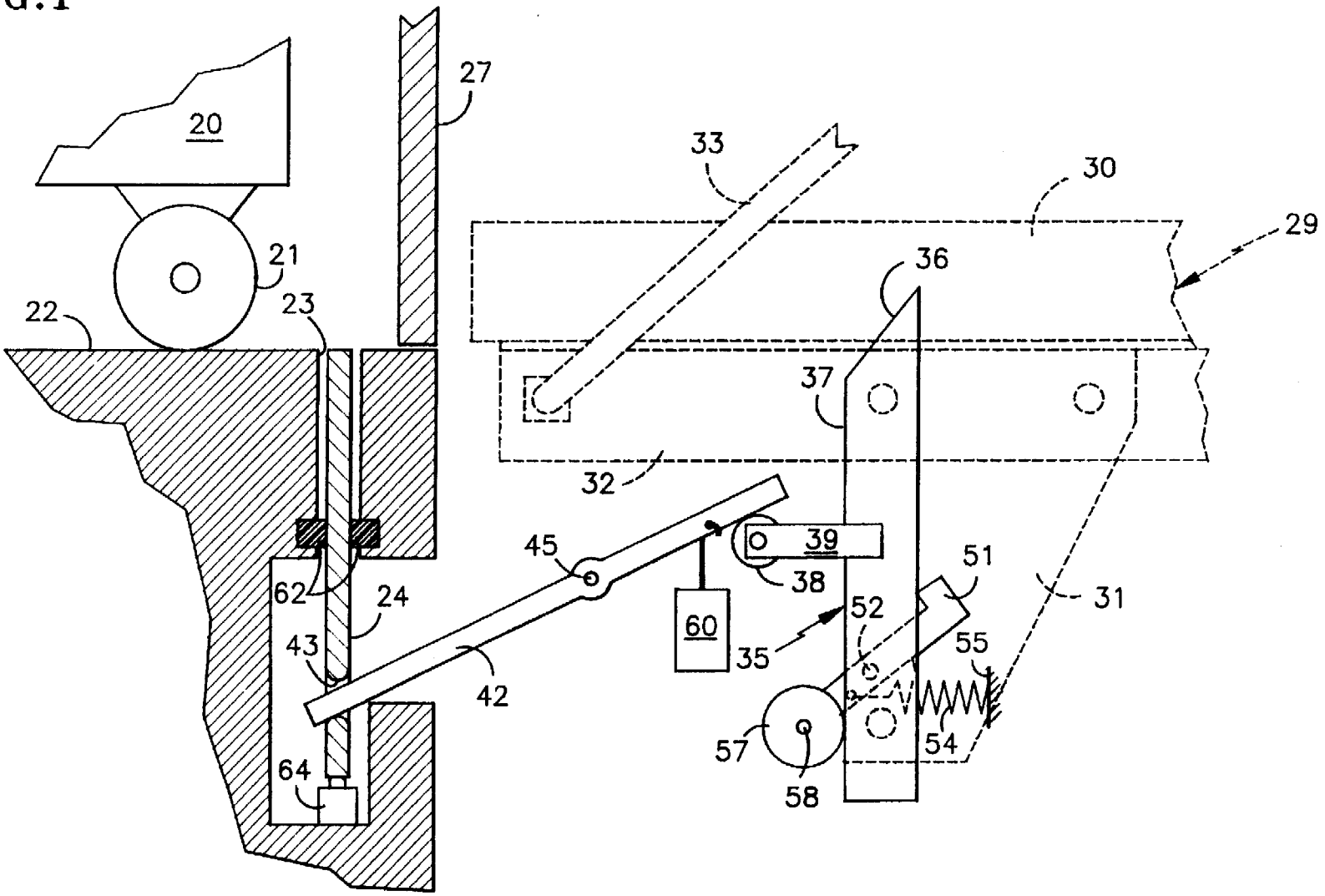
FIG. 1 is a stylized, partially sectioned, broken away side elevation view of a safety gate according to the invention at the top of a hoistway when lowered by the presence of an elevator car.

Referring now to FIG. 1, an elevator cab 20 is disposed on rollers 21 so that it may be rolled across the surface of a transfer floor 22 in a building over a slot 23 in the floor within which is slidably disposed the safety gate 24 of the present invention. When hoistway doors 27 are open, the cab 20 may roll onto an elevator car frame 29 with its rollers 21 within tracks 30. A mounting plate 31 is disposed on a frame member 32 that is attached to the plank of the car frame (not shown), and which also supports an angle brace 33 of the well-known type. The mounting plate 31 supports a cam structure 35 which includes an angled cam surface 36, a vertical cam surface 37, and a roller 38 rotatably disposed on an arm 39.

Figure 2:
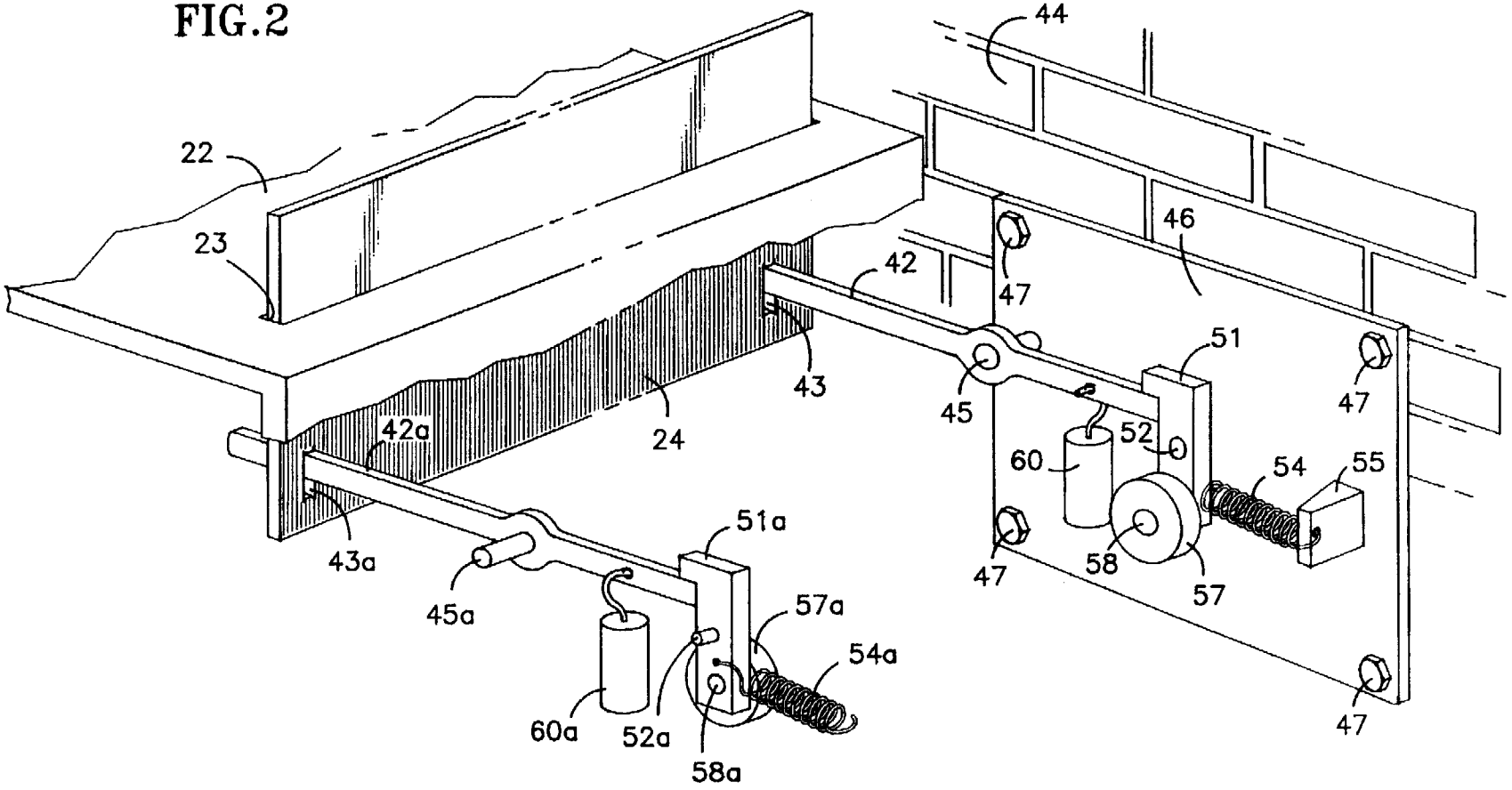
FIG. 2 is a partial, partially sectioned and broken away perspective view of the safety gate of FIG. 1.
Figure 3:
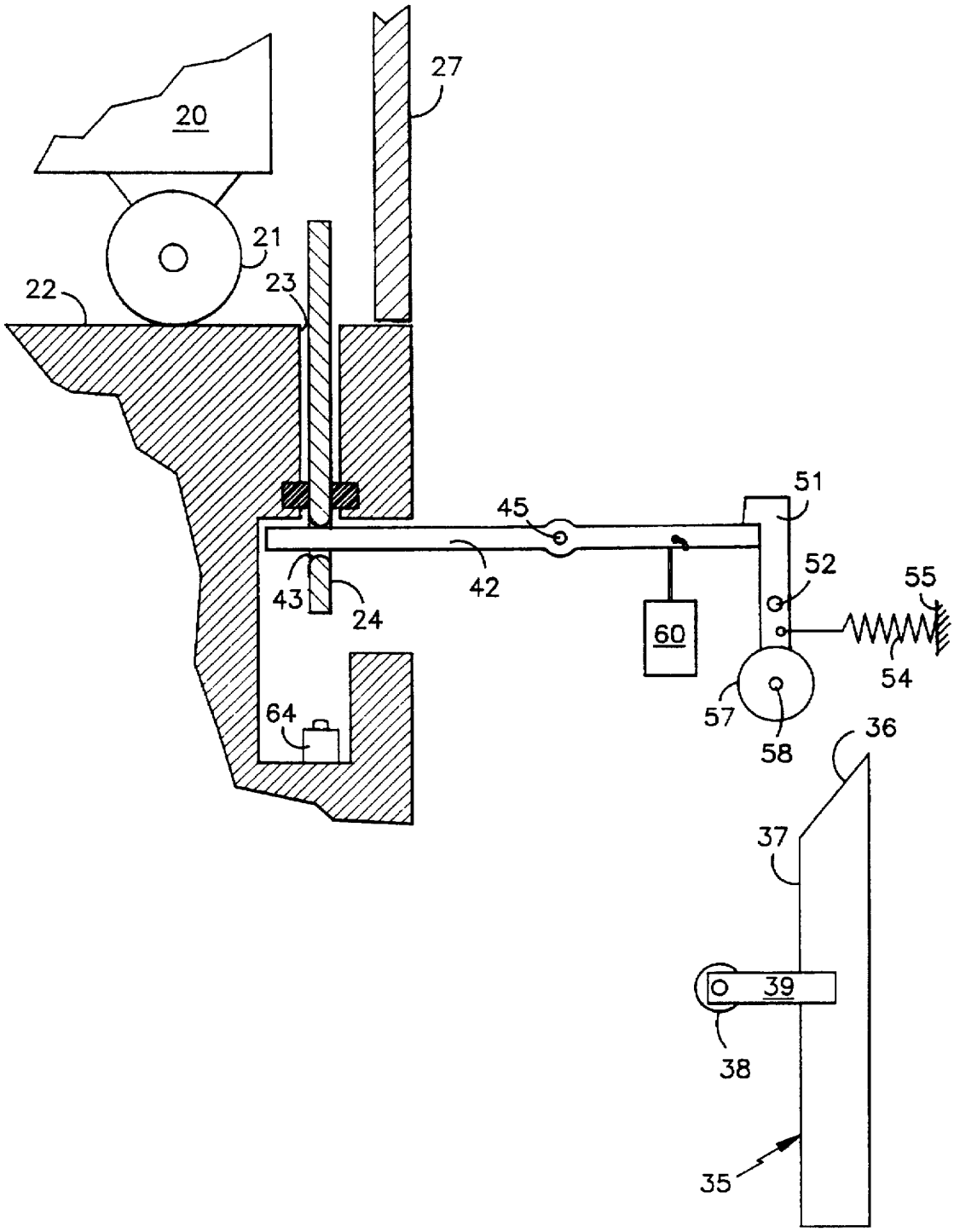
FIG. 3 is a stylized, partially sectioned, broken away side elevation view of the safety gate of FIG. 1 when latched in an upper, operative position, as an upwardly traveling elevator car approaches it.

An operating arm 42 extends through a slot 43 in the gate 24 and is rotatably fastened to the hoistway wall 44 (FIG. 2) by a pivot 45. The pivot 45 may be secured to a mounting plate 46 that can be secured in a suitable fashion to the wall 44 or a hoistway frame, such as with bolts 47. In FIGS. 2 and 3, the gate 24 is shown in an upper, operative position with the arm 42 latched in its fully counterclockwise position by means of a catch 51. The catch 51 is rotatably disposed on the plate 46 by a pivot 52. The catch 51 is urged into the latched position shown in FIGS. 2 and 3 by means of a tension spring 54 which is secured by an anchor 55 to the plate 46. The catch 51 has a roller 57 rotatably disposed thereon by means of a pivot 58. A weight 60 is held on the arm 42 on the side thereof opposite to the safety gate 24 so as to cause the arm 42 to naturally rotate into its full clockwise position, thereby to allow the catch 51 to engage the arm 42 and latch it in the position shown in FIGS. 2 and 3.

The arm 42, the latch 51 and the spring 54 are shown in FIG. 2 as disposed on a mounting plate 46 which in turn is mounted to the masonry structure 44 of the building, simply for the purpose of making it clear where the various parts are disposed relative to the elevator and to the building floor 22. In reality, such parts will likely be disposed on framework interconnected with the guide rails in the hoistway. Thus, the arm 42 (and so forth) are disposed to the building in a fashion which is common for ancillary parts of an elevator.

On the opposite end of the safety gate 24 from the notch 43, there is a similar notch **43*a* through which an arm 42*a*** extends. The arm 42*a* is associated with the same sort of apparatus as the arm 42, all of which have been designated by similar reference numerals to the apparatus described hereinbefore, with an "a" postscript. The apparatus bearing the "a" postscript is similarly disposed to the building by means of ordinary framing within the hoistway.

Figure 4:
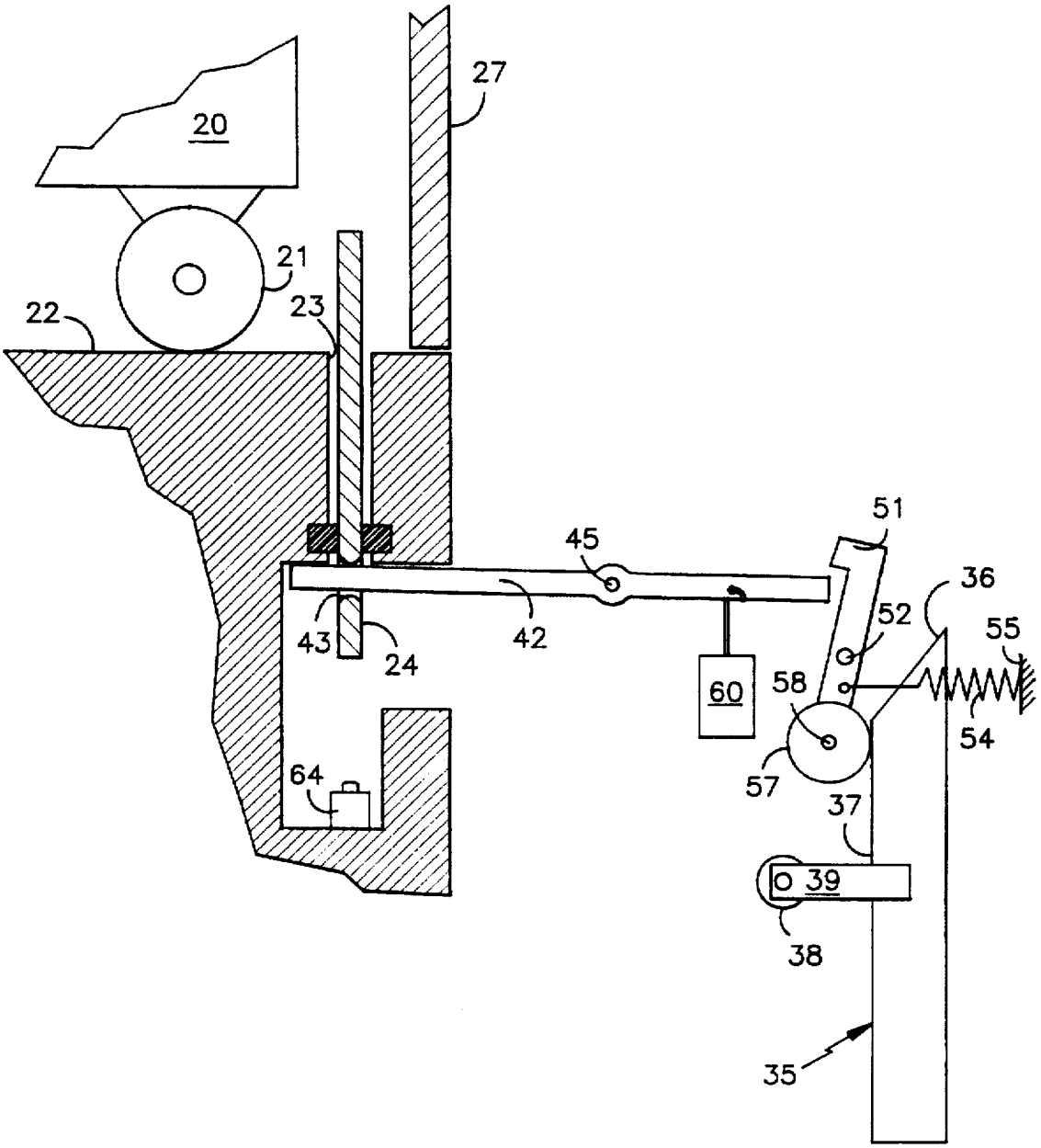
FIG. 4 is a stylized, partially sectioned, broken away side elevation view of the safety gate of FIG. 1 as a safety catch is released by a cam on an approaching elevator car.

When the elevator car frame 29 is not near the transfer floor where the safety gate 24 is disposed, it will be in the position shown in FIGS. 2 and 3. When the elevator has approached the floor and is almost level with it, the cam structure 35 which is fastened to the bottom of the elevator car frame will approach the roller 57 as seen in FIG. 3. Immediately thereafter the cam surface 36 contacts the roller 57 causing the catch 51 to rotate clockwise as seen in FIG. 4. However, because of the weight 60, the arm 42 remains in its fully clockwise position so that the gate 24 remains in its upward, operative position. However, as the elevator continues to rise, the roller 57 will be rotated slightly more clockwise by the cam surface 37 (as seen in FIG. 1) and the roller 38 will engage the arm 42 and rotate it anticlockwise into the position shown in FIG. 1. This lowers the gate 24 against the force of the weight 60. If desired, the movement of the gate 24 may be enhanced by sliding between self-lubricating guide strips, only a pair of such strips 62 (FIG. 1) being shown herein. Such strips may be made of nylon, teflon, delrin, or the like. If desired, a microswitch 64 may be positioned to sense when the gate is down (FIG. 1), for control purposes.

When a cab 20 is rolled onto the elevator car frame 29, it may then descend with the cab on it. As it begins to descend, the roller 38 also descends allowing the arm 42 to rotate clockwise into the position shown in FIG. 4 with the latch still rotated clockwise out of the way of the arm 42. Further descent causes the catch 51 to rotate fully anticlockwise and to latch the arm 42 with the gate in the upward position as seen in FIG. 3.

Figure 5:
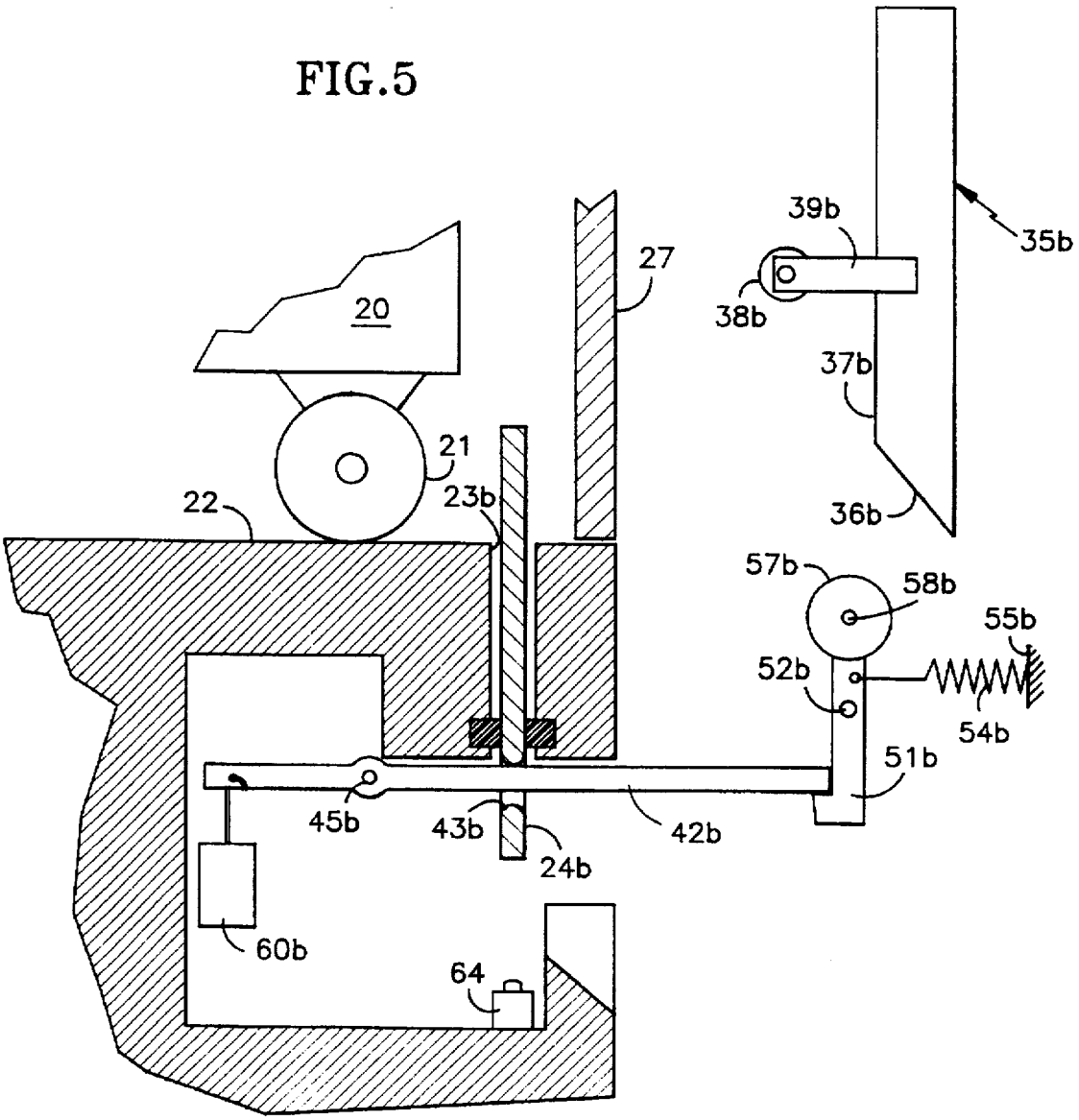
FIG. 5 is a stylized, partially sectioned, broken away side elevation view of an alternative form of the invention at the bottom of a hoistway operable by a downwardly-traveling elevator car, when latched in the upper operative position, as an elevator car approaches it.

The description thus far is of a configuration of the invention utilized with an elevator car that ascends up to a transfer floor at an upper end of a hoistway. A configuration of the invention utilized with an elevator car frame that descends to a transfer floor at a lower end of a hoistway is illustrated in FIG. 5. The principle of operation of the apparatus in FIG. 5 is identical to that illustrated and described with respect to FIGS. 1–4, hereinbefore. Similar apparatus is marked with the same reference numeral but with a "b" postscript.

The configuration of FIGS. 1–4 and of FIG. 5 are both shown with the hoistway disposed to the right of the landing, for ease of correlation of the two configurations. However, it may be typical that the gate 24 might be disposed at a landing at the right hand end of the floor 22 while a gate 24*b* would be disposed at a landing at a left hand end of the same floor (or vice versa). This is irrelevant to the invention. The gates 24, 24*b* herein are disclosed as being formed as a single piece. However, the invention encompasses gates comprised of more than one piece; for instance, in a particular elevator installation, the gate need only block the motion of the cab 20 at its wheels 21, if desired. Similarly, the invention is disclosed as being slidable within a slot 23 formed within the floor 22. However, the gate could instead be guided and supported by suitable framing attached to the floor 22, a wall 44, or other structure within the hoistway; the nature of the means for guiding the gate is irrelevant to the invention. The hoistway door 27 is shown for completeness only; obviously, in any instance where passengers will in no event be present on the floor 22, hoistway doors may be eliminated, if desired. On the other hand, if, in emergencies, or for any other purpose, passengers may at any time have access to the floor 22, then hoistway doors 27 should, of course, be provided. These and other aspects of the disclosed embodiment can be altered in a wide variety of ways while still taking advantage of the safety gate of the present invention.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A safety gate for preventing a horizontally movable elevator cab at a landing from inadvertently entering an elevator hoistway when an elevator car frame is not present at said landing to receive said cab, comprising:

a gate member vertically slidable between an upper position, in which a portion of it extends above the floor of said landing adjacent to said hoistway, thereby to obstruct passage of said cab along said floor toward said hoistway, and a lower position, in which said gate member does not obstruct passage of said cab along said floor toward said hoistway;

a moveable actuator engaging said gate member and moveable between a first position, in which it retains said gate member in said upper position, and a second position, in which it retains said gate member in said lower position, said actuator moving said gate between said upper and lower positions as said actuator moves between said first and second positions;

means for normally urging said gate member into said upper position and said actuator into said first position; and means disposed on said elevator car frame for moving said actuator into said second position as said elevator car frame approaches said landing.

2. A safety gate according to claim 1 wherein said gate member extends across said landing the full width of said cab.

3. A safety gate according to claim 1 wherein said actuator is an arm pivoted in said hoistway and is engaged by a cam on said car frame to be moved from said first position into said second position.

4. A safety gate according to claim 3 wherein said means for normally urging is a weight disposed on said arm to provide downward vertical pull on a portion of said arm which is on the opposite side of said pivot from a portion of said arm which engages said gate member.

5. A safety gate according to claim 4 wherein said weight is disposed on a side of said arm on the same side of said gate member as said hoistway; and said means disposed on said elevator car frame moves said actuator as it approaches said landing from a point in said hoistway below said landing.

6. A safety gate according to claim 4 wherein said weight is disposed on a side of said arm on the opposite side of said gate member from said hoistway; and said means disposed on said elevator car frame moves said actuator as it approaches said landing from a point in said hoistway above said landing.

* * * * *